US011060794B2

(12) United States Patent
Bai et al.

(10) Patent No.: US 11,060,794 B2
(45) Date of Patent: Jul. 13, 2021

(54) GAS-LIQUID HEAT EXCHANGER

(71) Applicant: SHENZHEN ESIN TECHNOLOGY INC., LTD., Guangdong (CN)

(72) Inventors: Bentong Bai, Guangdong (CN); Junqiang Xu, Guangdong (CN); Yuqing Bai, Guangdong (CN)

(73) Assignee: SHENZHEN ESIN TECHNOLOGY INC., LTD., Guangdong (CN)

( * ) Notice: Subject to any disclaimer, the term of this patent is extended or adjusted under 35 U.S.C. 154(b) by 217 days.

(21) Appl. No.: 16/331,445

(22) PCT Filed: May 11, 2018

(86) PCT No.: PCT/CN2018/086607
§ 371 (c)(1),
(2) Date: Mar. 7, 2019

(87) PCT Pub. No.: WO2019/153564
PCT Pub. Date: Aug. 15, 2019

(65) Prior Publication Data

US 2020/0386492 A1 Dec. 10, 2020

(30) Foreign Application Priority Data

Feb. 12, 2018 (CN) ..... 201810147044.5

(51) Int. Cl.
*F28F 9/02* (2006.01)
*F28D 1/053* (2006.01)
(Continued)

(52) U.S. Cl.
CPC ..... *F28D 1/05308* (2013.01); *F28F 1/04* (2013.01); *F28F 1/12* (2013.01); *F28F 9/02* (2013.01)

(58) Field of Classification Search
CPC ..... F28F 1/04; F28F 1/12; F28F 9/02; F28F 9/0207; F28F 9/0297; F28D 1/05308; F28D 1/0443; F28D 2001/028
See application file for complete search history.

(56) References Cited

U.S. PATENT DOCUMENTS 3,368,617 A * 2/1968 Malek ..... F28F 9/0221 165/175
2015/0007971 A1* 1/2015 Lee ..... F28D 20/00 165/173
2019/0170455 A1* 6/2019 McCaffrey ..... F28F 9/0224

FOREIGN PATENT DOCUMENTS

CH 148715 A * 8/1931 ..... F28D 1/05308
CN 101769690 A 7/2010
(Continued)

*Primary Examiner* — Devon Russell
(74) *Attorney, Agent, or Firm* — Dinsmore & Shohl LLP

(57) ABSTRACT

The invention relates to a gas-liquid heat exchanger comprising a first liquid distributor, a second liquid distributor and heat exchange assemblies connecting the first liquid distributor and the second liquid distributor. A flow equalizer plate and a liquid guiding plate are arranged on the first liquid distributor to equalize the incoming liquid. On the heat exchange assemblies are arranged longitudinally-finned tubes, which are evenly distributed in an array. The fins on two adjacent longitudinally-finned tubes are arranged in an alternating manner to achieve heat exchange assemblies providing small wind resistance, large heat transfer surface area and long heat transfer stroke. Therefore, the heat exchanger has uniform liquid distribution, small wind resistance, large heat transfer surface area, long heat transfer stroke, gas-liquid counter-flow arrangement and high heat transfer efficiency.

10 Claims, 16 Drawing Sheets

(51) Int. Cl.
*F28F 1/04* (2006.01)
*F28F 1/12* (2006.01)

(56) References Cited

FOREIGN PATENT DOCUMENTS

| | | | | | |
|---|---|---|---|---|---|
| CN | 101949663 | A | * | 1/2011 | ..... F28D 1/05316 |
| CN | 101949663 | A | | 1/2011 | |
| CN | 102466426 | A | | 5/2012 | |
| CN | 202734640 | U | | 2/2013 | |
| CN | 103471427 | A | | 12/2013 | |
| CN | 104285121 | A | | 1/2015 | |
| CN | 104864748 | A | | 8/2015 | |
| CN | 107941054 | A | | 4/2018 | |
| DE | 2305615 | A1 | * | 8/1974 | ..... F28D 1/05308 |
| DE | 9415857 | U1 | * | 11/1995 | ..... F28F 9/02 |
| JP | 2005030741 | A | | 2/2005 | |
| WO | WO-2018018049 | A1 | * | 1/2018 | ..... F28F 1/32 |
| WO | WO-2020004292 | A1 | * | 1/2020 | ..... F28F 9/22 |

* cited by examiner

GAS-LIQUID HEAT EXCHANGER

RELATED APPLICATION

The present application claims priority to Chinese Patent Application No. 201810147044.5, filed on Feb. 12, 2018, the disclosure of which is incorporated herein by reference.

FIELD OF THE INVENTION

The invention relates to the technical field of heat exchangers, and more particularly to a gas-liquid heat exchanger, which is applicable where high heat transfer efficiency is required, such as energy-saving central air conditioner, high-efficiency cooling equipment of a data center, etc.

BACKGROUND OF THE INVENTION

A heat exchanger is a device used to transfer heat between two mediums. A gas-liquid heat exchanger is a device used to transfer heat between gas and liquid, and is commonly used in liquid cooling or air conditioning, such as air conditioner, coolant radiator used in an automobile, high temperature liquid cooling, gas-liquid exchange in the chemical industry and energy-saving heat recovery, etc. A problem with the conventional gas-liquid heat exchangers is that the time and stroke for heat exchange between gas and liquid are insufficient, resulting in inefficient heat exchange. Furthermore, the uniformity of the distribution of gas and liquid inside the device determines the heat transfer efficiency. Therefore, to improve the efficiency of gas-liquid exchangers, it is necessary to design a high efficient liquid and gas flow arrangement.

SUMMARY OF THE INVENTION

In view of this, the present invention provides a gas-liquid heat exchanger employing a highly efficient fluids flow arrangement, by which the internal pressure differentials cause liquid flow, and thus maximizing distribution uniformity of liquid flow. The heat exchanger also has the following advantages, such as small wind resistance, large heat transfer area, long time and stroke for gas-liquid heat exchange and gas-liquid counter-flow arrangement, achieving the improvement of heat transfer efficiency.

A gas-liquid heat exchanger, comprising:

a first liquid distributor provided with a liquid inlet arranged on one side of the first liquid distributor, a plurality of first sub-flow equalizers arranged to be spaced from each other and a first main flow equalizer that connects to the plurality of first sub-flow equalizers, the liquid inlet communicating with the plurality of first sub-flow equalizers via the first main flow equalizer, a gap between two adjacent first sub-flow equalizers acting as a gas outlet, a flow equalizer plate being arranged inside each of the first main flow equalizer and the plurality of first sub-flow equalizers to uniformly divide the liquid, each of the plurality of first sub-flow equalizers further comprising a liquid guiding plate arranged obliquely inside the first sub-flow equalizer and above the flow equalizer plate;

a second liquid distributor provided with a liquid outlet arranged on one side of the second liquid distributor, a plurality of second sub-flow equalizers arranged to be spaced from each other and a second main flow equalizer that connects to the plurality of second sub-flow equalizers, the liquid outlet communicating with the plurality of second sub-flow equalizers via the second main flow equalizer, a gap between two adjacent second sub-flow equalizers acting as a gas inlet;

heat exchange assemblies connecting the first liquid distributor and the second liquid distributor, the heat exchanger assemblies comprising a plurality of longitudinally-finned tubes evenly distributed in an array, each of the plurality of longitudinally-finned tubes comprising a liquid guiding tube and a plurality of fins connecting to the liquid guiding tube and perpendicular to the liquid guiding tube, the liquid guiding tube having one end communicating with one of the plurality of first sub-flow equalizers, and the other end communicating with one of the plurality of second sub-flow equalizers, a cross section of the longitudinally-finned tube parallel to a length direction of the liquid guiding tube being a rectangle, each of the plurality of fins extending along a length direction of the liquid guiding tube, the plurality of fins being evenly distributed around the liquid guiding tube, the plurality of fins on two adjacent longitudinally-finned tubes being arranged in an alternating manner, and the adjacent longitudinally-finned tubes fitting closely with each other.

In one embodiment, a flow equalizer plate and a liquid guiding plate are arranged on the first liquid distributor to equalize the incoming liquid. On the heat exchange assemblies are arranged longitudinally-finned tubes, which are evenly distributed in an array. The fins on two adjacent longitudinally-finned tubes are arranged in an alternating manner to achieve heat exchange assemblies providing small wind resistance, large heat transfer surface area and long heat transfer stroke. Therefore, the heat exchanger has uniform liquid distribution, small wind resistance, large heat transfer surface area, long heat transfer stroke, gas-liquid counter-flow arrangement and high heat transfer efficiency.

In one embodiment, the longitudinally-finned tube included in the heat exchange assemblies is a rectangular longitudinally-finned tube. The rectangular longitudinally-finned tube includes a rectangular liquid guiding tube and a plurality of fins that connect to the rectangular liquid guiding tube and perpendicular to the rectangular liquid guiding tube. The fins are uniformly distributed on the upper and lower sides of the liquid guiding tube.

In another embodiment, the longitudinally-finned tube included in the heat exchange assemblies is a round longitudinally-finned tube. The round longitudinally-finned tube includes a round liquid guiding tube and a plurality of fins that connect to the round liquid guiding tube and perpendicularly and radially extend outwards with respect to the round liquid guiding tube as an axis.

In yet another embodiment, the first liquid distributor is further provided with a flow divider side tube that connects to an end of the first main flow equalizer. The flow divider side tube and the first main flow equalizer communicate with each other. The liquid inlet connects to the flow divider side tube.

In yet another embodiment, the flow equalizer plate is an orifice plate.

In yet another embodiment, the flow equalizer plate is a louver-type guiding plate.

In yet another embodiment, the cross section of the fin parallel to the radial direction of the rectangular liquid guiding tube is a rectangle or a curve.

In yet another embodiment, the fin is provided with a sub portion.

In yet another embodiment, the cross section of the second sub-flow equalizer perpendicular to the length direction is in the shape of a bullet that protrudes away from the heat exchange assemblies.

In still another embodiment, the cross section of the second sub-flow equalizer perpendicular to the length direction is a triangle that protrudes away from the heat exchange assemblies.

REFERENCE NUMERALS

Figure 1:
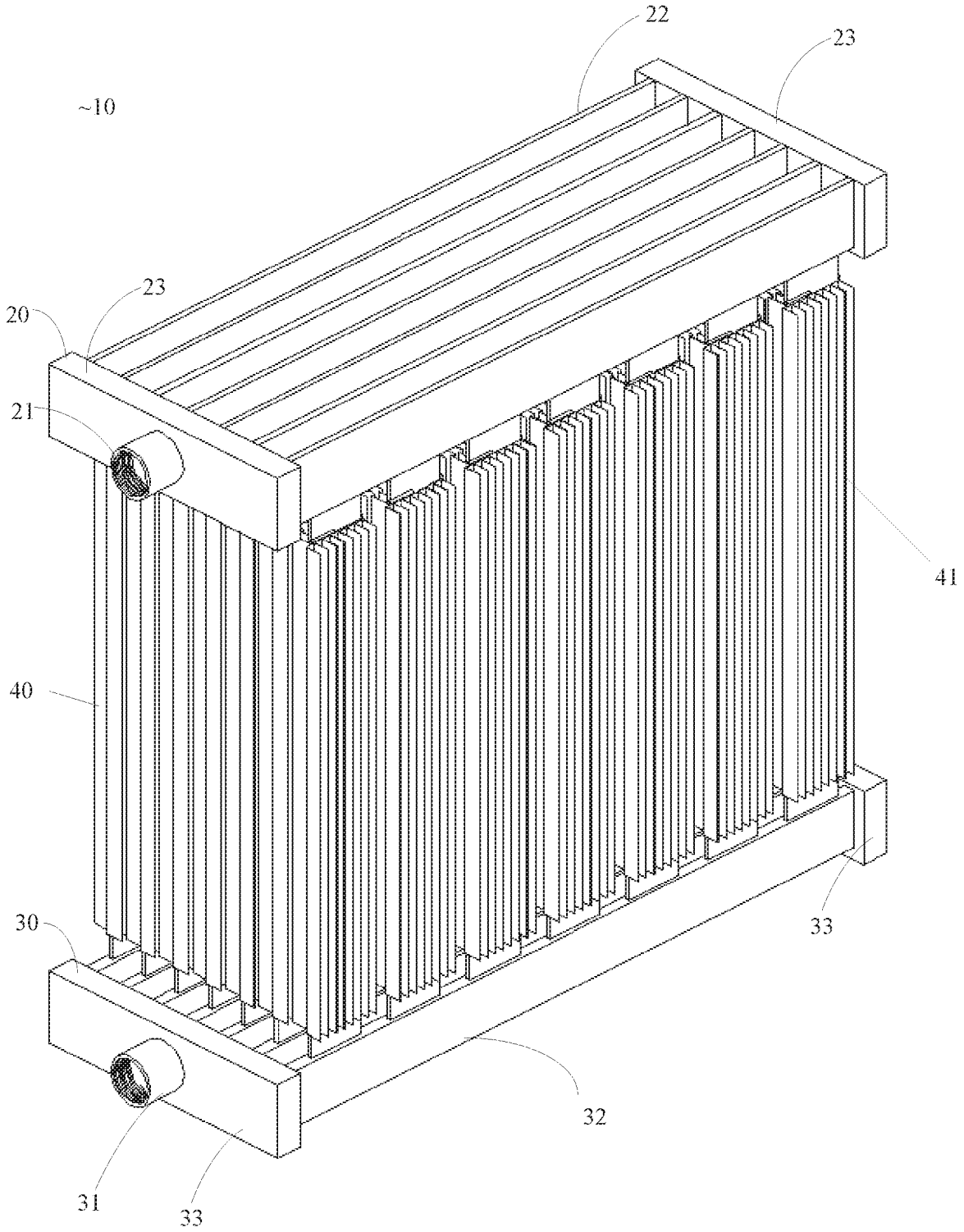
FIG. 1 shows a gas-liquid heat exchanger of Example 1 according to the present invention.

10 gas-liquid heat exchanger;

20 first liquid distributor, 21 liquid inlet, 22 first sub-flow equalizer, 23 first main flow equalizer, 24 flow divider side tube, 25 flow equalizer plate, 251 flow equalizer holes, 252 slats, 26 liquid guiding plate;

30 second liquid distributor, 31 liquid outlet, 32 second sub-flow equalizer, 33 second main flow equalizer; and

40 heat exchange assemblies, 41 longitudinally-finned tube, 42 liquid guiding tube, 43, 43*a*, 43*b*, 43*c*, 43*d* fins.

DETAILED DESCRIPTION OF THE INVENTION

The present invention will be described more fully hereinafter with reference to the accompanying drawings. Preferred embodiments of the invention are shown in the drawings. However, the invention may be made in many different forms and is not limited to the embodiments described herein. These embodiments are provided to explain the disclosure of the invention in detail.

It should be noted that when an element is referred to as being "fixed" to another element, it may refer to that the element is directly arranged on the other element, or that there is an intermediate element arranged between them. When an element is referred to as being "connected" to another element, it may refer to that the element is directly connected to the other element, or that there is an intermediate element arranged between them.

Unless otherwise defined, all technical and scientific terms used herein have the same meaning as commonly understood by those skilled in the art. The terminology is used to describe embodiments in the description, but is not intended to limit the invention.

Example 1

Figure 2:
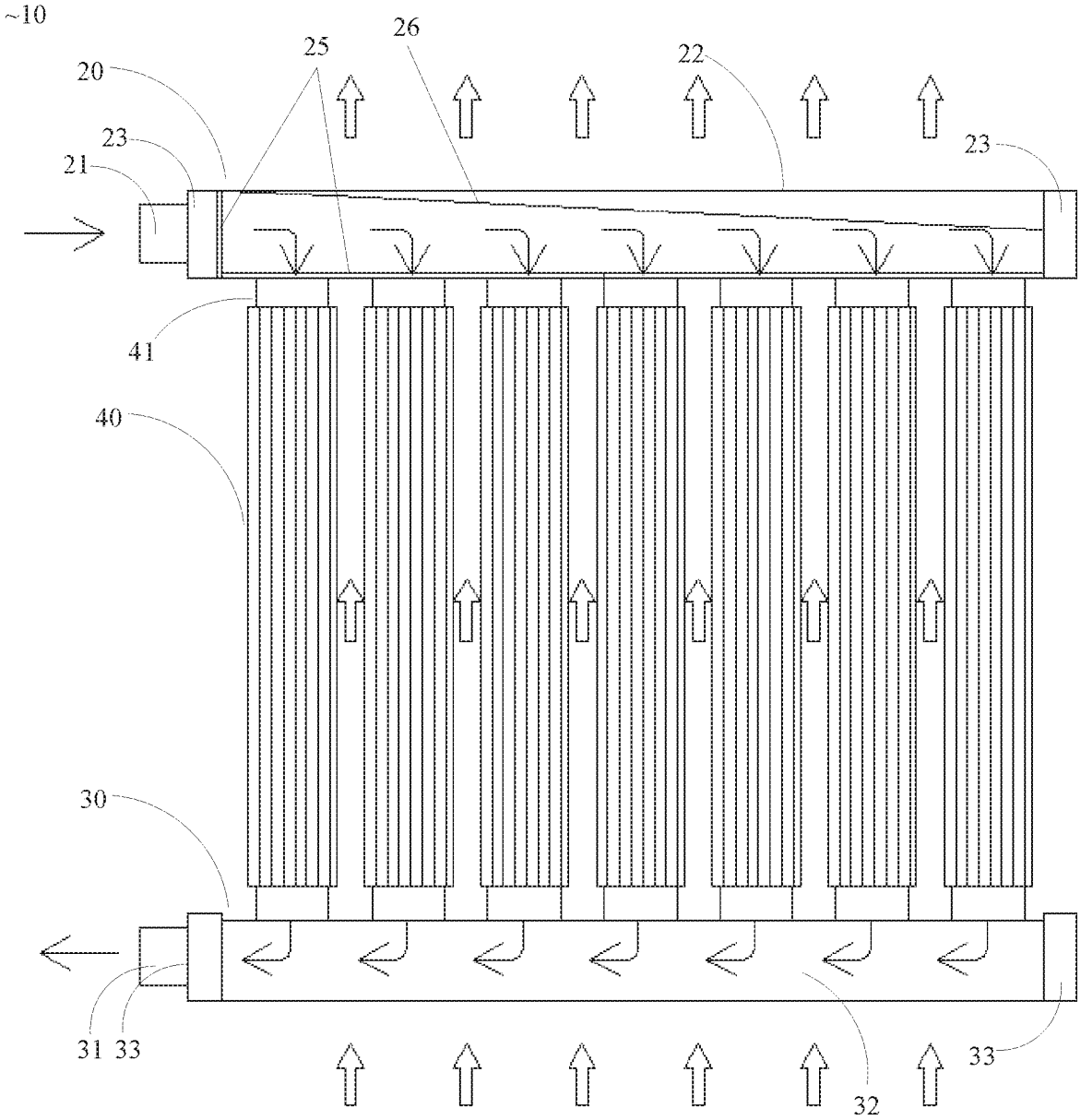
FIG. 2 shows the working principle of the gas-liquid heat exchanger shown in FIG. 1.

As shown in FIGS. 1 and 2, a gas-liquid heat exchanger 10 includes a first liquid distributor 20, a second liquid distributor 30 arranged parallel to the first liquid distributor 20, and heat exchange assemblies 40 that connect to the first liquid distributor 20 and the second liquid distributor 30. The first liquid distributor 20 is configured to introduce liquid and uniformly distribute the liquid flow, and acts as a gas outlet. The second liquid distributor 30 is configured to collect and discharge the liquid, and acts as a gas inlet. The heat exchange assemblies are configured to direct liquid from the first liquid distributor 20 to the second liquid distributor 30 and direct gas from the second liquid distributor 30 to the first liquid distributor 20, and act as a main place for gas-liquid heat exchange. Hereinafter, each component will be described in detail.

The first liquid distributor 20 configured to be a cuboid is provided with a liquid inlet 21, seven spaced first sub-flow equalizers 22 and a first main flow equalizer 23 that connects to the first sub-flow equalizers 22. A flow equalizer plate 25 configured to uniformly divide the flow is provided inside the first main flow equalizer 23 and the first sub-flow equalizers 22. A liquid guiding plate 26 is arranged inside the first sub-flow equalizers 22. The liquid inlet 21 is arranged at one end of each of the first sub-flow equalizers 22. The liquid inlet 21 connects to one end of the first sub-flow equalizer 22 via one first main flow equalizer 23 and communicates with the first sub-flow equalizer 22. In other embodiments, two or more liquid inlets 21 are evenly arranged on one side of the first liquid distributor 20. The first sub-flow equalizers 22 are hollow tubes and uniformly spaced, where the gap between two adjacent first sub-flow equalizers 22 acts as a gas outlet gap.

Figure 3:
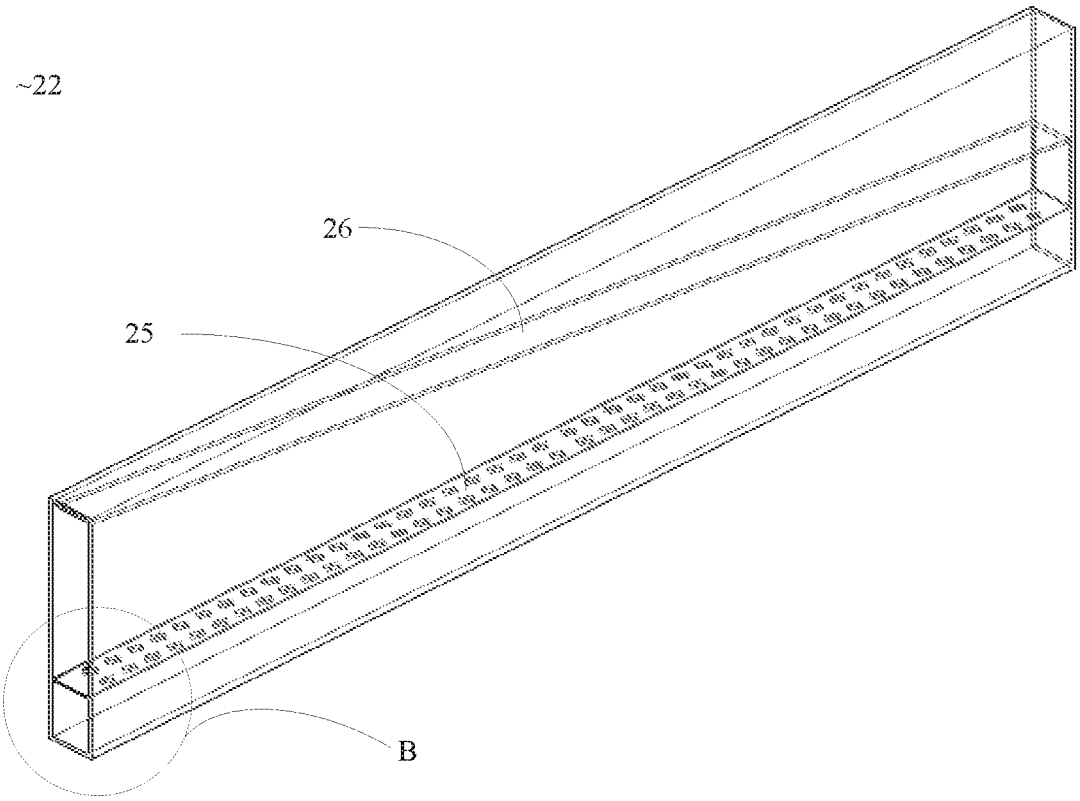
FIG. 3 shows the structure of the first sub-flow equalizer shown in FIG. 1.

In this embodiment, a flow equalizer plate 25 configured to uniformly divide the flow is provided inside the first main flow equalizer 23 and the first sub-flow equalizers 22. The first sub-flow equalizer 22 further includes a liquid guiding plate 26 arranged at an oblique angle inside the first flow equalizer and above the flow equalizer plate, as shown in FIG. 3. The liquid guiding plate 26 is arranged at an oblique angle inside the first sub-flow equalizer 22, such that the liquid within the first flow equalizer 22 away from the liquid inlet 21 is blocked by the liquid guiding plate 26 to facilitate the increase of the pressure of the liquid flowing through. Therefore, the pressure and the flow velocity of the liquid flowing through beneath the flow equalizer plate becomes larger, making the liquid flow through the flow equalizer plate more uniform.

Figure 4:
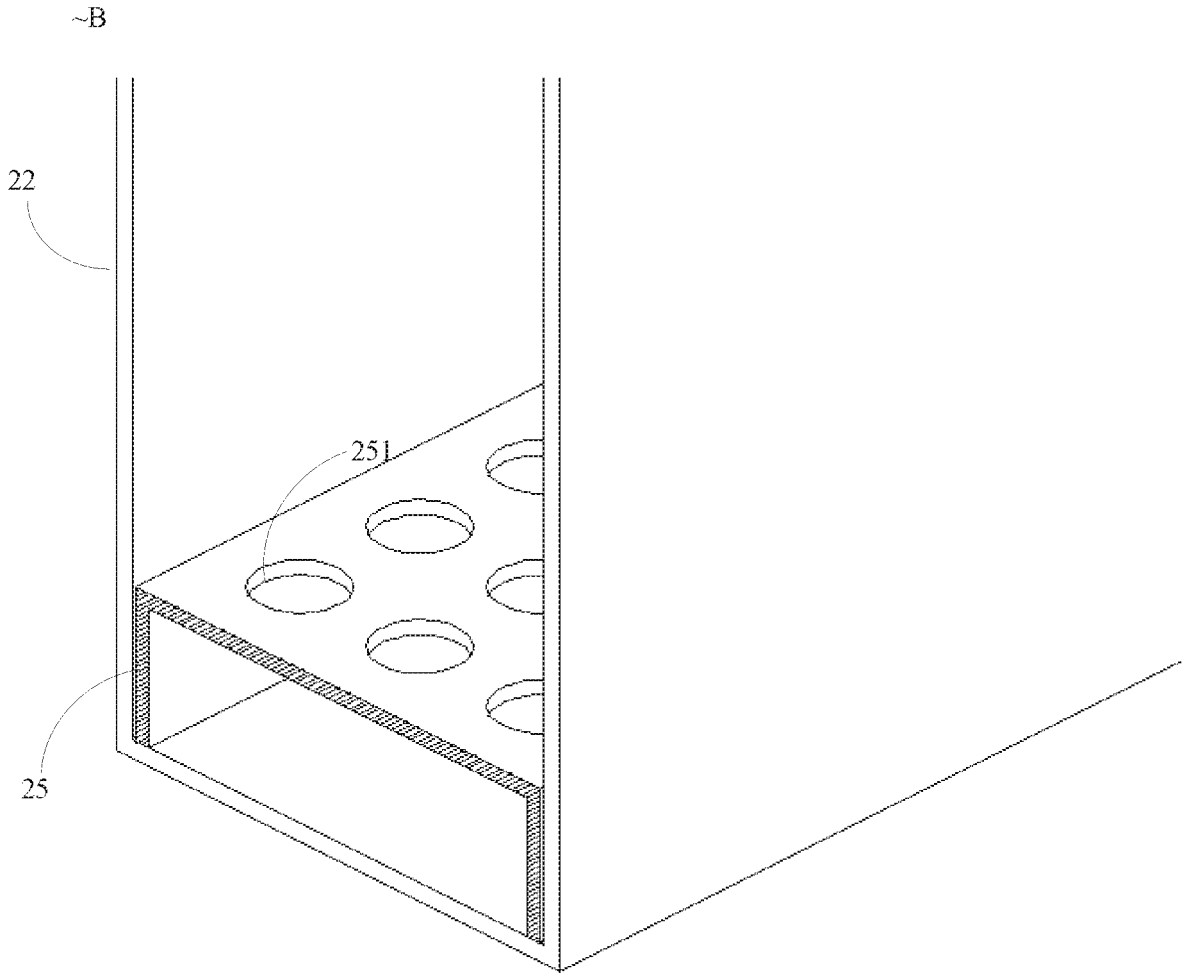
FIG. 4 is a partially enlarged schematic view showing one embodiment of Part B of FIG. 3.
Figure 5:
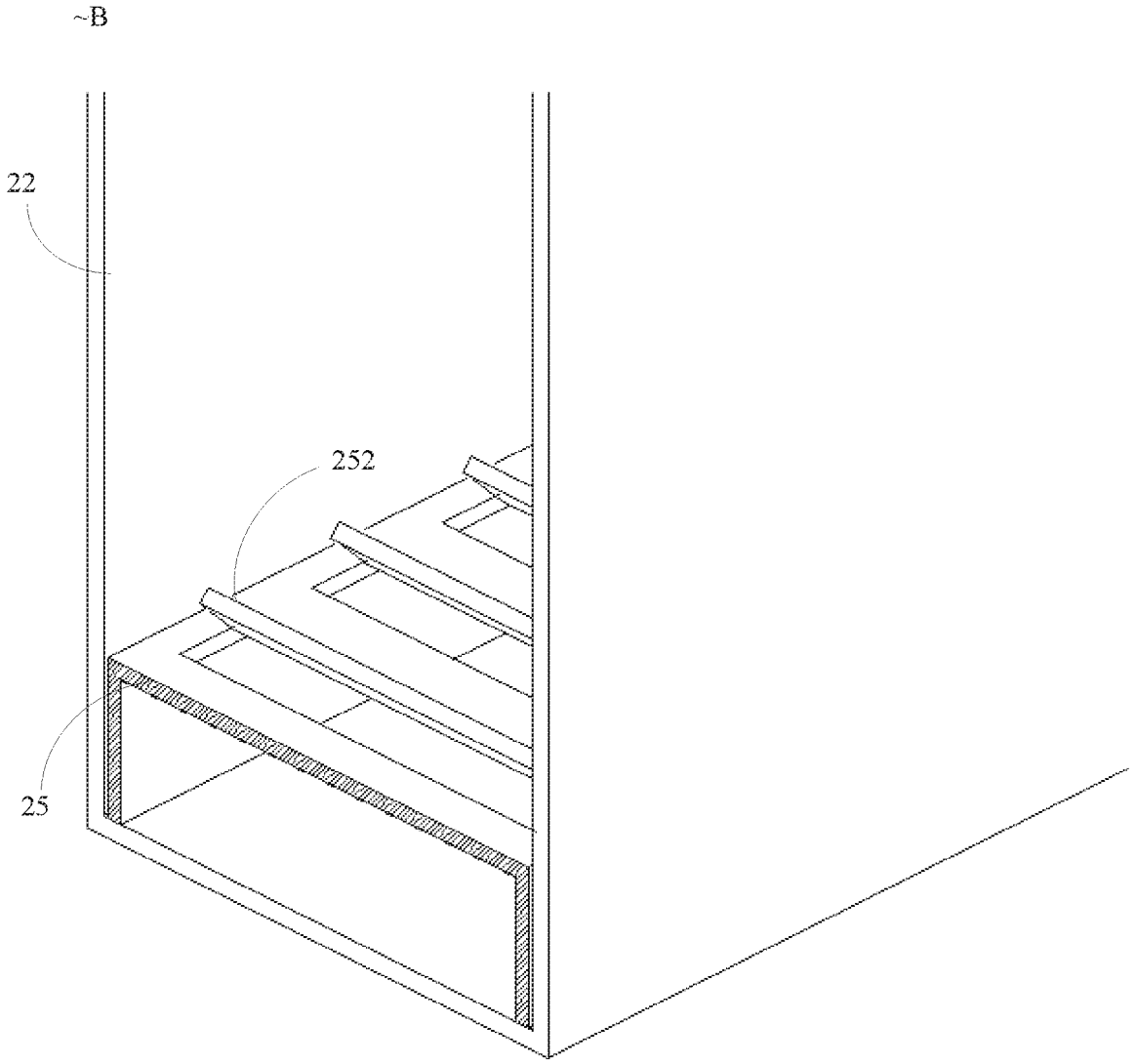
FIG. 5 is a partially enlarged schematic view showing another embodiment of Part B of FIG. 3.

In this embodiment, the flow equalizer plate 25 is shown in FIGS. 4 and 5. When the flow equalizer plate 25 is arranged in the first main flow equalizer 23, liquid enters the first main flow equalizer 23 via the liquid inlet 21, and first encounters the flow equalizer plate 25, by which most of the liquid flow passages are blocked. The liquid is forced to converge in the passages through the flow equalizer plate under a large pressure and at a high flow velocity. The liquid that flows through each passage is relatively uniform. The liquid flow passages through the flow equalizer plate may be hole-shaped passages as shown in FIG. 4, or louvered passages as shown in FIG. 5. The flow equalizer plate shown in FIG. 4 is a U-shaped plate provided with a plurality of flow equalizer holes 251 at its top, wherein side wall of the flow equalizer plate 25 is fixed to the first main flow equalizer 23 or the first sub-flow equalizer 22. The flow equalizer plate shown in FIG. 5 is a U-shape plate provided with a plurality of slats 252 and a square liquid guiding groove at its top, wherein the angle between the slats and the square liquid guiding groove is in a range of from 0 to 30 degrees. The projection of the slats 252 on the square liquid guiding groove at least includes the cross section of the square liquid guiding groove. The flow equalizer plate 25 is fixed to the first main flow equalizer 23 or the first sub-flow equalizer 22 via the sidewall of the U-shaped plate. As described herein, the slats 252 on the louver-type flow equalizer plate will transversely divide the liquid flowing through the surface thereof, such that the transverse flow velocity of the surrounding liquid is relatively uniform and therefore the transverse flow velocity of the liquid across the flow equalizer is relatively uniform.

The second liquid distributor 30 configured to be a cuboid corresponding to the first liquid distributor 20 is provided with a liquid outlet 31, seven spaced second sub-flow equalizers 32 and a second main flow equalizer 33 that connects the second sub-flow equalizers 32. The liquid outlet 31 is arranged at one end of each of the second sub-flow equalizers 32. The liquid outlet 31 connects to one end of the second sub-flow equalizer 32 via one second main flow equalizer 33 and communicates with the second sub-flow equalizer 32. In other embodiments, two or more liquid outlets 31 are evenly arranged on one side of the second liquid distributor 30. The second sub-flow equalizers 32 are hollow tubes and uniformly spaced, where the gap between two adjacent second sub-flow equalizers 32 acts as a gas inlet gap. In the present embodiment, the second sub-flow equalizer 32 is arranged opposite and parallel to the first sub-flow equalizer 22.

Figure 6:
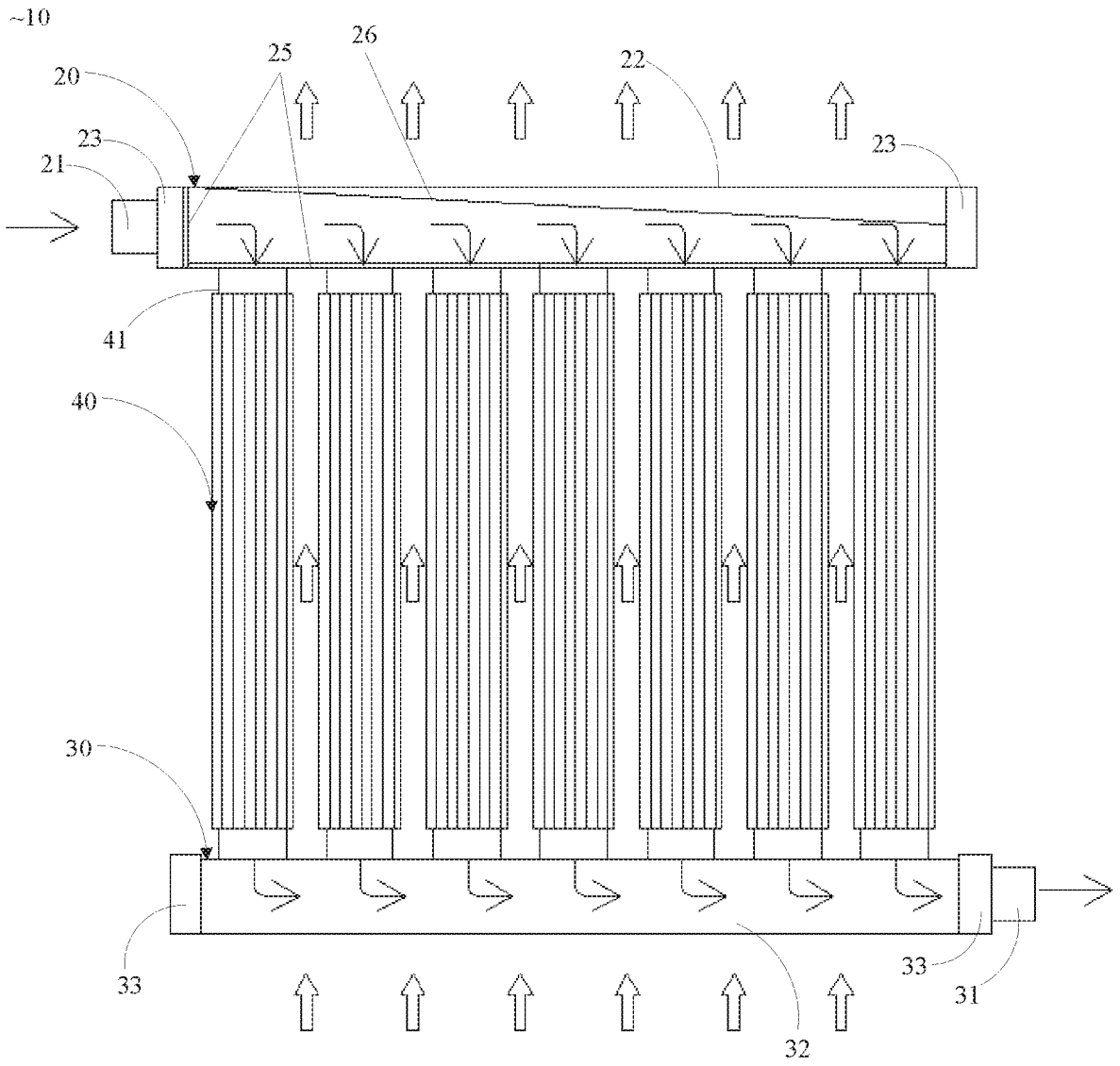
FIG. 6 shows the working principle of another embodiment of the gas-liquid heat exchanger shown in FIG. 1.

In this embodiment, the liquid inlet 21 and the liquid outlet 31 are arranged on the same side of the heat exchange assemblies 40. In other embodiments, the liquid outlet 31 may be arranged on the side of the heat exchange assemblies 40 opposite the liquid inlet 21, as shown in FIG. 6. In one embodiment where the liquid inlet and the liquid outlet 31 are arranged on the same side of the heat exchange assemblies 40, such arrangement is convenient for installation and space-saving. In one embodiment where the liquid inlet and the liquid outlet 31 are arranged on opposite sides of the heat exchange assemblies 40, such arrangement consumes a slightly larger installation space but has a slightly longer stroke for fluid heat exchange and a slightly higher heat transfer efficiency.

In this embodiment, as shown in FIG. 1, the heat exchange assemblies 40 include a **7*7 array of forty-nine rectangular longitudinally-finned tubes 41. The outer contours of two adjacent rectangular longitudinally-finned tubes 41 abut against each other. As shown in FIG. 6, the outer contour of the cross section of each of the rectangular longitudinally-finned tubes 41 parallel to the radial direction of the rectangular liquid guiding tube 42 is a rectangle. Each of the rectangular longitudinally-finned tubes 41 includes a rectangular liquid guiding tube 42 and sixteen fins 43 that connect to the rectangular liquid guiding tube 42 and perpendicular to the rectangular liquid guiding tube 42. One end of the rectangular liquid guiding tube 42 communicates with the first sub-flow equalizer 22, and the other end of the rectangular liquid guiding tube 42 communicates with the second sub-flow equalizer 32. The radial extension direction of the fins 43 coincides with the radial extension direction of the rectangular liquid guiding tube 42**.

In this embodiment, the heat exchange assemblies 40 are composed of longitudinally-finned tubes. The fins and the liquid guiding tubes extend in the same direction, in which the liquid flows through the liquid guiding tube and gas flow between the fins. In such counter-flow arrangement where gas and liquid flow in opposite directions, gas flows in the radial direction along the surface of the fins and the surface of the liquid guiding tubes. Compared with the conventional transversely-finned tube or spiral type heat exchangers, the present heat exchanger embodiment with such flow arrangement reduces resistance to the gas, i.e. the resistance to gas per unit stroke, so that a longitudinally-finned tube having a long stroke is made possible in this embodiment. In practice, in the presence of a certain wind resistance to a single finned tube, the longitudinally-finned tube used in the present embodiment can be provided as a finned tube having a long stroke, which improves the gas-liquid heat exchange efficiency of a single finned tube.

Figure 7:
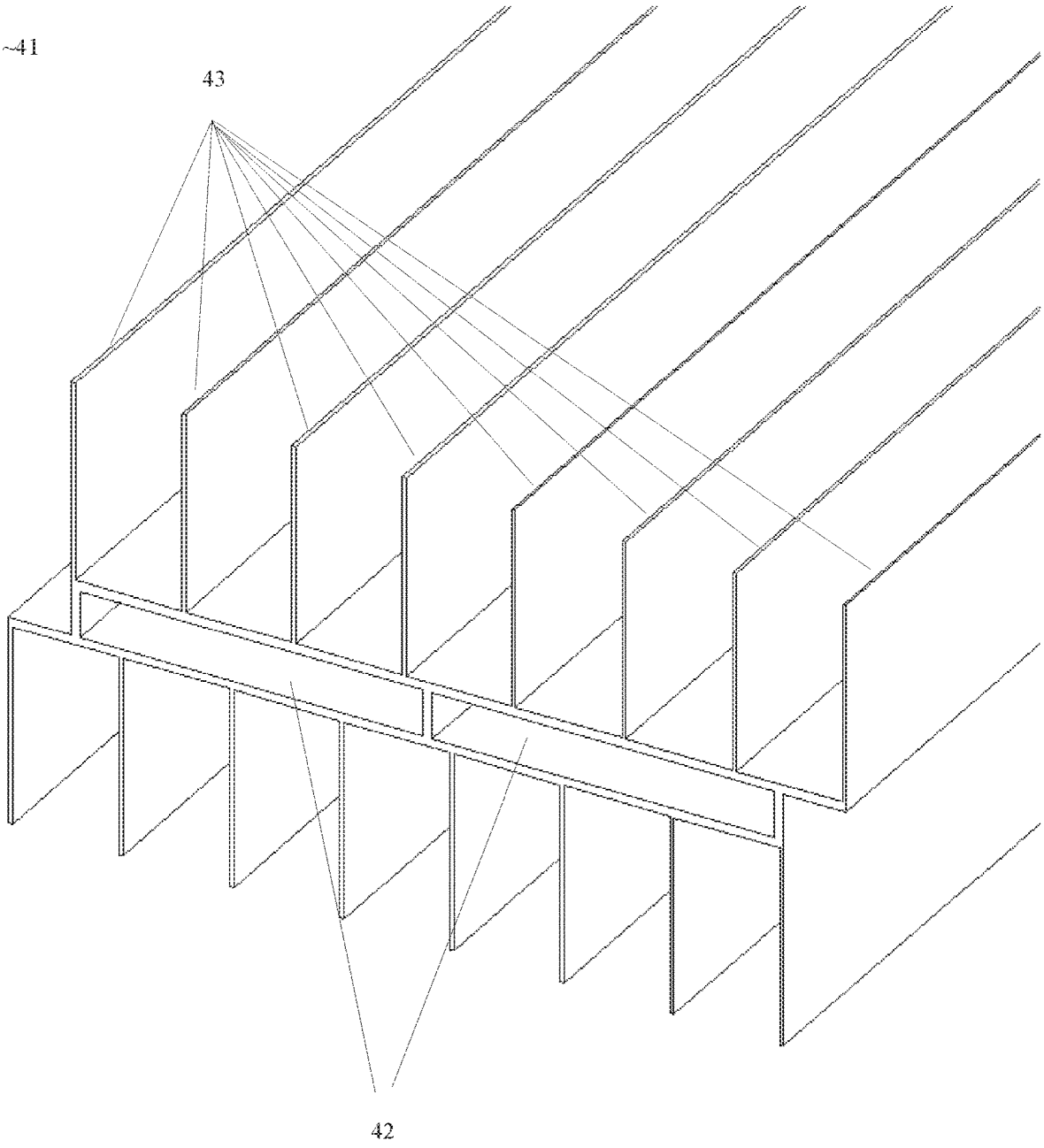
FIG. 7 shows the structure of a rectangular finned tube of the heat exchange assemblies shown in FIG. 1.
Figure 8:
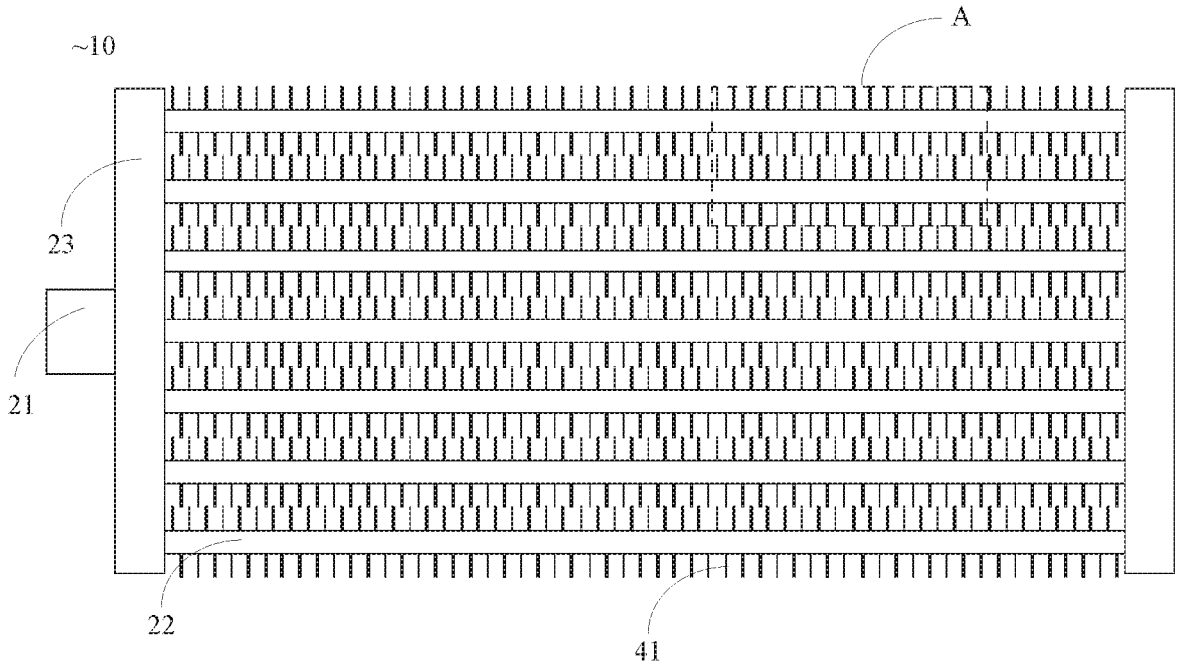
FIG. 8 is a plan view of the gas-liquid heat exchanger shown in FIG. 1.
Figure 9:
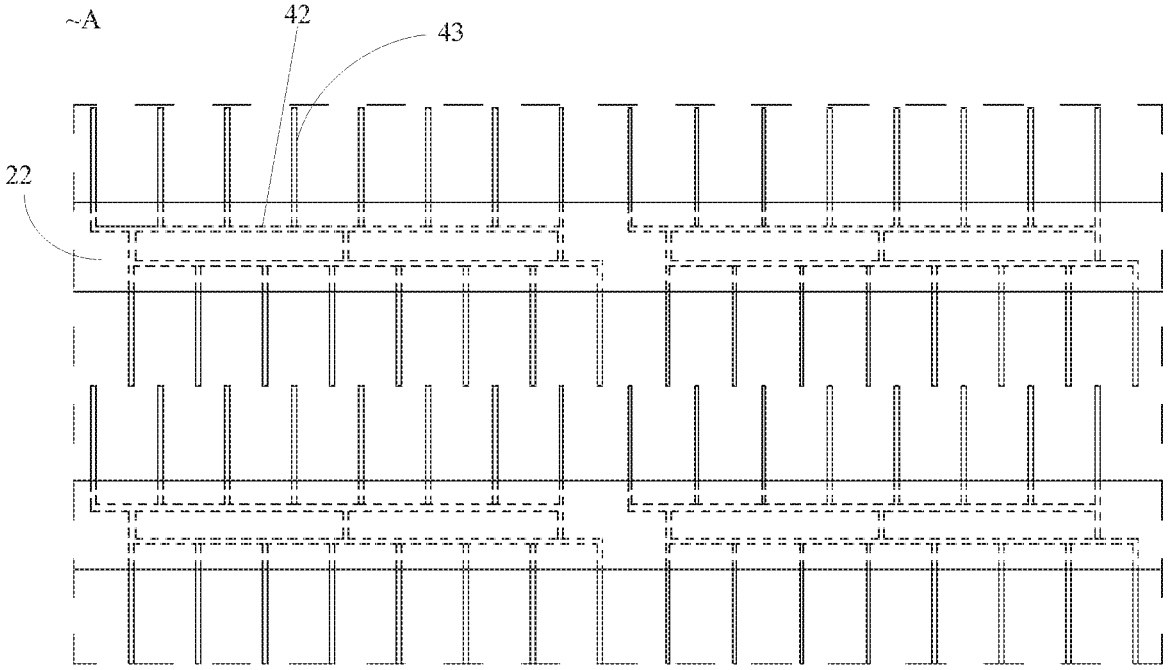
FIG. 9 is a partially enlarged schematic view showing Part A of FIG. 8.

In this embodiment, the cross section of the fins 43 parallel to the radial direction of the rectangular liquid guiding tube 42 is a rectangle. As shown in FIG. 7, the fins 43 on the rectangular longitudinally-finned tube 41 are asymmetrically distributed, in which the fins 43 are evenly distributed on the upper and lower sides of the rectangular liquid guiding tube and the fins on the upper and lower sides are asymmetrical in the distribution. As shown in FIGS. 8 and 9, the outer contours of two adjacent rectangular longitudinally-finned tubes 41 abut against each other and the adjacent fins 43 on two adjacent rectangular longitudinally-finned tubes 41 are arranged in an alternating manner, making the gas flow passages formed between the fins 43 to communicate with each other, effectively reducing the wind resistance to the gas flow past the gap between individual fins.

Figure 10:
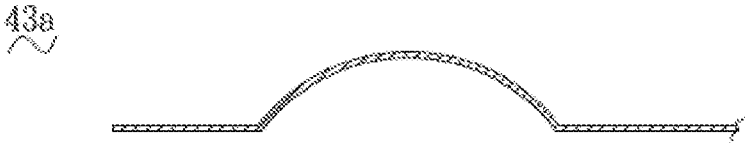
FIG. 10 is a sectional view showing a first embodiment of the fin according to the present invention.
Figure 11:
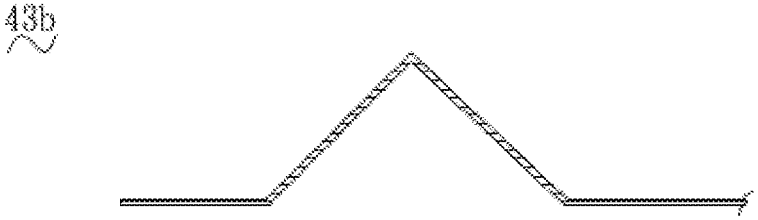
FIG. 11 is a sectional view showing a second embodiment of the fin according to the present invention.
Figure 12:
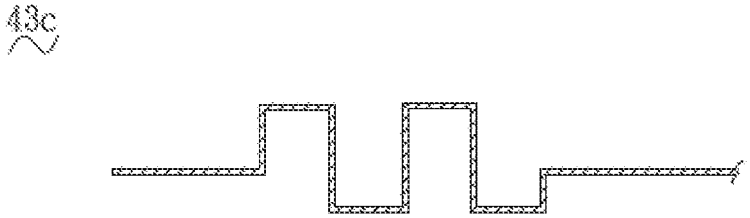
FIG. 12 is a sectional view showing a third embodiment of the fin according to the present invention.
Figure 13:
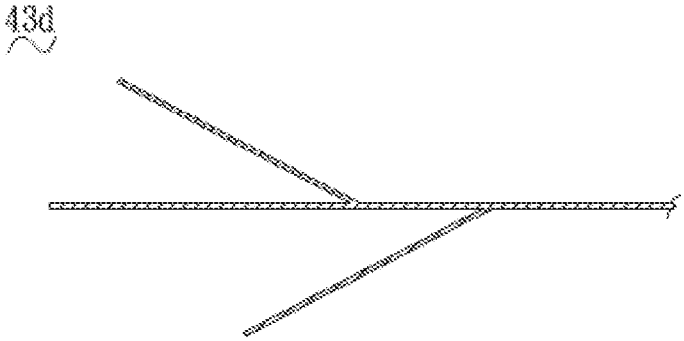
FIG. 13 is a sectional view showing a fourth embodiment of the fin according to the present invention.

In other embodiments, the cross section of the fins 43 parallel to the radial direction of the rectangular liquid guiding tube 42 is a curve. For example, as shown in FIG. 10, a curved projection is provided in the intermediate portion of the fin 43*a*. Alternatively, as shown in FIG. 11, a triangular projection is provided in the intermediate portion of the fin 43*b*. Alternatively, as shown in FIG. 12, a concave-convex portion is provided in the fins 43*c*. Further, the fins 43 may be provided with a branch portion. For example, as shown in FIG. 13, the fins 43*d* are provided with branches extending toward both sides. Moreover, in other embodiments, the number of fins 43 on each of the rectangular longitudinally-finned tubes 41 can be adjusted as needed. The number of fins 43 on the upper side of the rectangular liquid guiding tube 42 may be different from that of the fins on the lower side, as long as the heat exchanger formed of the rectangular finned tubes meets the requirements of high heat transfer efficiency and low wind resistance. In other embodiments, when the wind resistance to the heat exchange assemblies 40 is large, spacing may be reserved between two adjacent rectangular longitudinally-finned tubes 41 to reduce resistance to the gas flow.

In this embodiment, the fins are preferably densely arranged to provide a long stroke, resulting in moderate wind resistance to the heat exchange assemblies 40, large heat exchange surface of the heat exchange assemblies 40, long stroke and high heat exchange efficiency.

Figure 14:
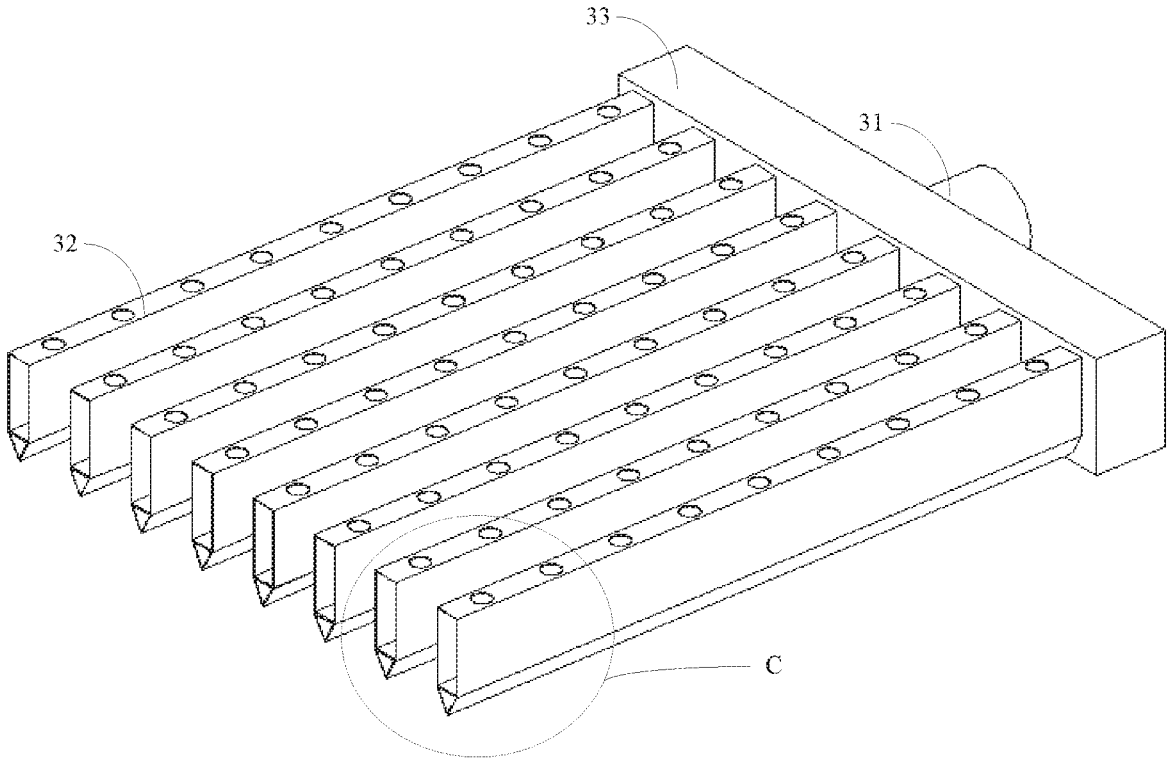
FIG. 14 is a half-sectional view showing one specific embodiment of the second sub-flow equalizer shown in FIG. 1.
Figure 15:
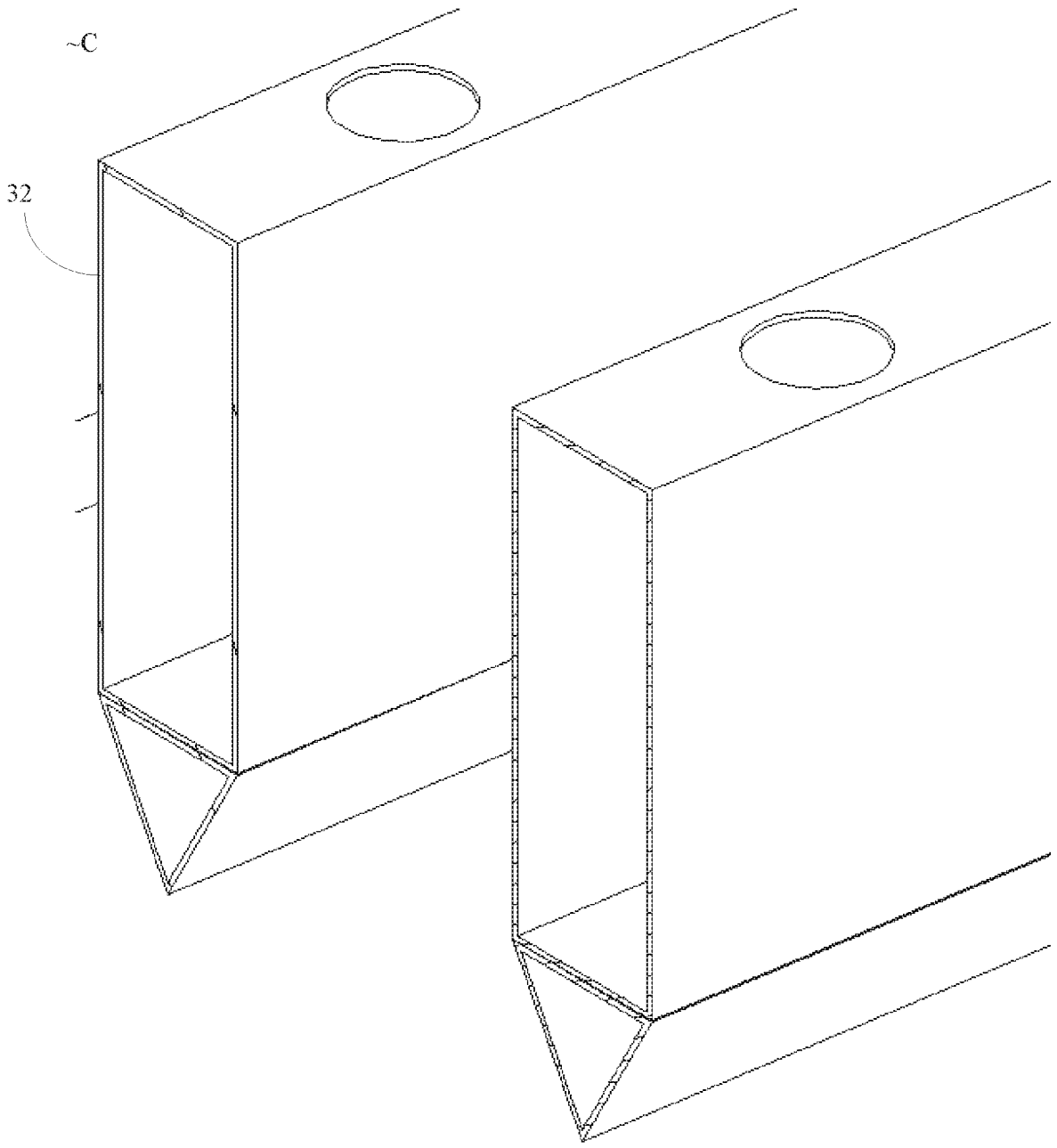
FIG. 15 is a partially enlarged schematic view showing one embodiment of Part C of FIG. 14.
Figure 16:
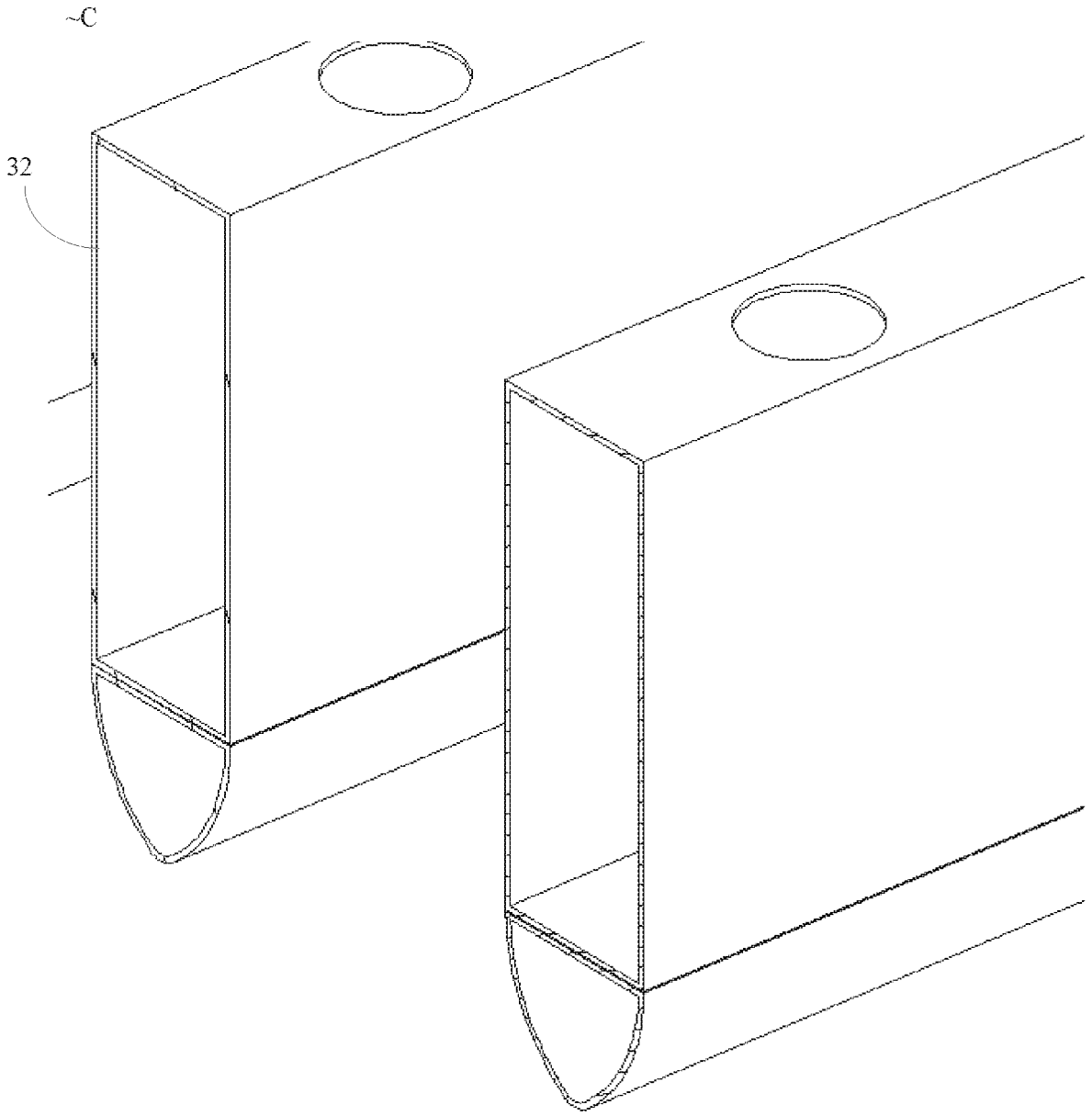
FIG. 16 is a partially enlarged schematic view showing another embodiment of Part C of FIG. 14.

As shown in FIGS. 14, 15 and 16, in order to reduce the wind resistance while the gas entering, the cross section of the second sub-flow equalizer 32 perpendicular to the length direction is in the shape of a bullet that protrudes away from the heat exchange assemblies 40 or a triangle. With this design, the width of the inlet of the gas gap is greater than the width of its outlet, and the resistance to gas is smaller.

In addition, the material of the first liquid distributor 20, the second liquid distributor 30 and the heat exchange assemblies 40 may be selected from metal or plastic, or other types of inorganic synthetic materials, organic synthetic materials, etc.

Working principle will be explained in detail below.

As shown in FIG. 2 or 6, liquid enters the first main flow equalizer 23 from the liquid inlets 21 on both sides of the first liquid distributor 20, in which the liquid is uniformly divided via the flow equalizer plate 25 arranged inside the first main flow equalizer 23, and then the liquid uniformly enters the first sub-flow equalizer 22. Subsequently, via the flow equalizer plate 25 and liquid guiding plate 26 arranged inside the first sub-flow equalizer 22, the liquid flows through the rectangular liquid guiding tube 42 of the rectangular longitudinally-finned tube 41. The liquid runs over the rectangular guiding tube 42 and merges in the second sub-flow equalizer 32 of the second liquid distributor 30, and then the liquid passes through the second sub-flow equalizer 32 and exits from the liquid outlets arranged on both sides of the second liquid distributor 30. Gas enters the heat exchanger from the underneath of the second liquid distributor 30 and travels perpendicularly to the liquid distributor through the gas inlets between two adjacent second branch equalizers 32. Gas guiding grooves for gas circulation are formed between the fins 43 on the rectangular longitudinally-finned tubes 41, and the gas guiding grooves are parallel to the rectangular liquid guiding tubes 42. Gas flows through the gas guiding grooves to the first liquid distributor 20 and exits upward from the gas outlet between two adjacent first sub-flow equalizers 22. The liquid flow through the rectangular longitudinally-finned tube 41 and the gas flow outside the rectangular longitudinally-finned tube 41 in opposite directions, in which the heat transfer between the two fluids is achieved in a countercurrent manner through the rectangular longitudinally-finned tube 41.

It should be noted that, in this embodiment, the rectangular longitudinally-finned tubes 41 layout can be extended in longitudinal and/or transverse direction by increasing the number and length. The performance and heat transfer efficiency of the heat exchanger 10 will be further improved by extending its length in the radial direction. In addition, the rectangular longitudinally-finned tubes 41 in this embodiment are evenly distributed with respect to the first liquid distributor 20 and the second liquid distributor 30. The rectangular longitudinally-finned tubes can uniformly divide the fluids (both liquid and gas), which is beneficial to the improvement of heat transfer efficiency.

In practice, the gas-liquid heat exchanger 10 can be assembled into a liquid or gas cooling device together with other components such as a fan, an enclosure, etc. For example, an enclosure is provided with openings on the top and bottom, in which the opening on the top acts as a gas outlet and the opening on the bottom acts as a gas inlet. A fan is mounted to the gas outlet, and a gas-liquid heat exchanger 10 is mounted to the inner cavity within the enclosure. Being driven by the fan, the external gas goes from bottom to top, and the liquid in the gas-liquid heat exchanger 10 goes from the top to the bottom. The liquid in the gas-liquid heat exchanger 10 is cooled by the external gas, in which the gas-liquid heat exchanger 10 is used as a liquid cooling device, such as a closed cooling tower. Alternatively, an enclosure is provided with openings on the top and bottom, in which the opening on the top acts as a gas inlet and the opening on the bottom acts as a gas outlet. A fan is mounted to the gas outlet, and a gas-liquid heat exchanger 10 is mounted to the inner cavity within the enclosure. Being driven by the fan, the external gas goes from top to bottom, and the liquid in the gas-liquid heat exchanger 10 goes from the bottom to the top (which is a reversed situation with respect to the above liquid cooling device). The circulating gas is cooled by the liquid in the gas-liquid heat exchanger 10, in which the gas-liquid heat exchanger 10 is used as a gas cooling device, such as a terminal air conditioner, an indoor unit of an air conditioner and a chilled water precision air conditioner.

In summary, according to this embodiment, inside the first main flow equalizer and the first sub-flow equalizer of the first liquid distributor are provided the flow equalizer plate, and the first sub-flow equalizer is provided with a liquid guiding plate, thus achieving a uniform liquid division in advance of the heat exchange assemblies. The liquid uniformly enters the heat exchange assemblies. An array of rectangular longitudinally-finned tubes is arranged on the heat exchange assemblies, where the fins are arranged in an alternating manner. Gas between fins is subjected to a small wind resistance. Gas merges in the gas passages between the adjacent fins, further reducing the wind resistance to each fin. Low wind resistance to the fins allows the heat exchange stroke and distribution of the fins may be increased as desired. Large heat transfer area, long heat exchange stroke is made possible. In this embodiment, high-density long-stroke fins are preferred, which provide a moderate wind resistance to the heat exchange assemblies. The second sub-flow equalizer of the second liquid distributor is designed to have a low wind resistance structure in a bullet shape or a triangle shape, thus reducing the wind resistance to the second liquid distributor. Overall, the gas-liquid heat exchanger has the advantages that liquid distributes uniformly, and that small wind resistance to the gas through a fin, and that fins are arranged densely and provide long stroke. Further, the heat changer has large surface area and long stroke for heat exchange. The gas-liquid counter-flow arrangement leads to the improvement of the heat transfer efficiency.

Example 2

Example 2 differs from Example 1 in that round longitudinally-finned tubes instead of rectangular longitudinally-finned tubes are employed as the heat exchange assemblies, as shown in FIGS. 16 to 19. The round longitudinally-finned tube includes a round liquid guiding tube and a plurality of fins that connect to the round liquid guiding tube and perpendicularly and radially extend outwards with respect to the round liquid guiding tube as an axis.

Figure 18:
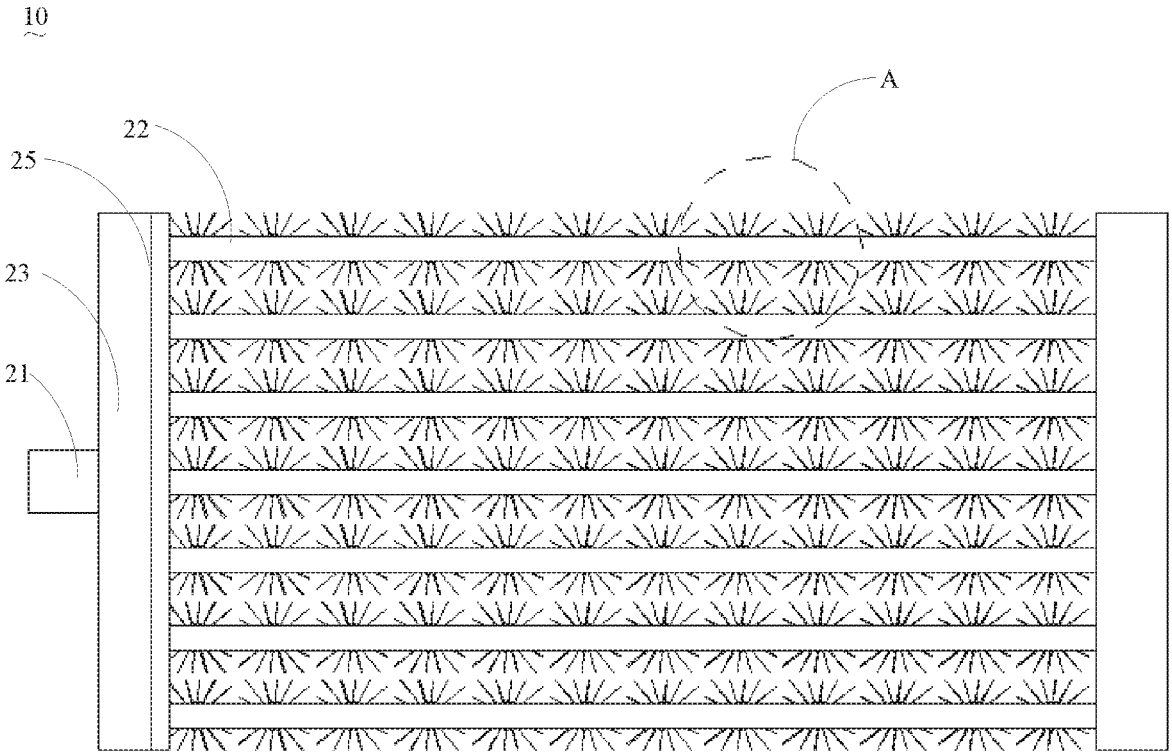
FIG. 18 is a plan view of the gas-liquid heat exchanger shown in FIG. 17.
Figure 19:
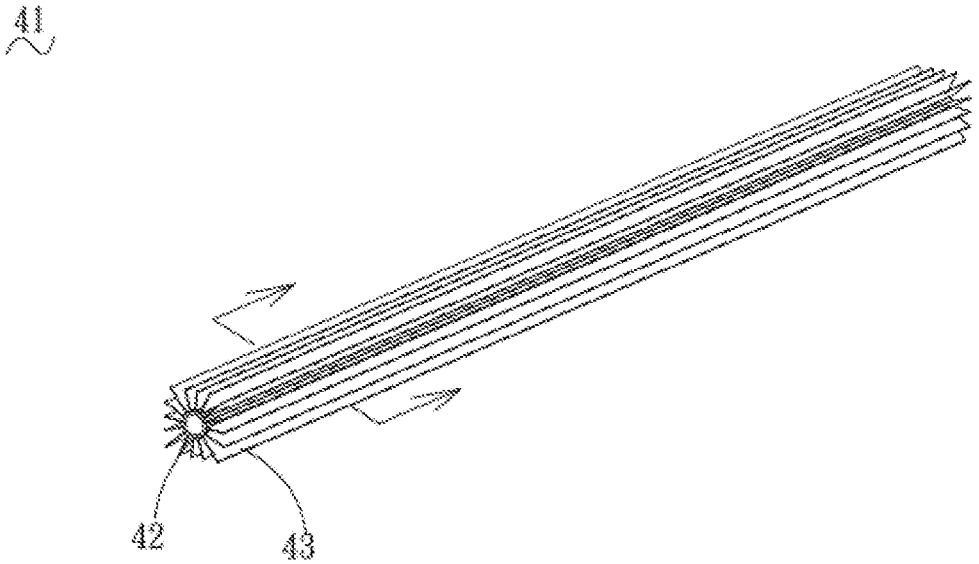
FIG. 19 shows the structure of a round finned tube of the heat exchange assemblies shown in FIG. 17.

In this embodiment, the round longitudinally-finned tube 41 shown in FIG. 19 is composed of round liquid guiding tube 42 and fins 43, wherein the fins 43 perpendicularly and radially extend outwards with respect to the round liquid guiding tube as an axis. The fins 43 of the two adjacent round finned tubes 41 are arranged in an alternating manner as shown in FIG. 18. The specific shape of the fin 43 is the same as that of the fin of Example 1, which may be a rectangle, a curve or a branched shape as shown in FIGS. 10 to 13.

Figure 17:
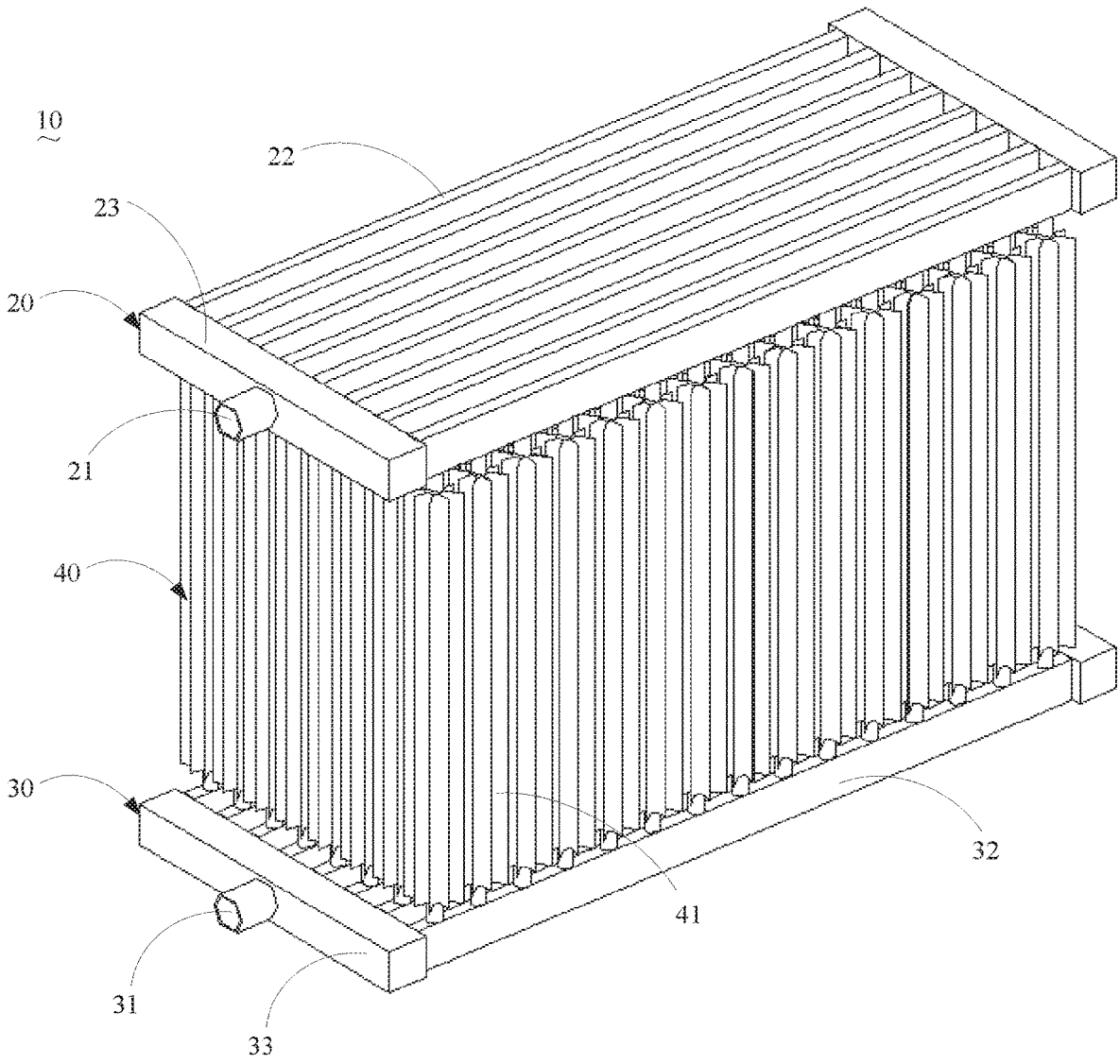
FIG. 17 shows a gas-liquid heat exchanger of Example 2 according to the present invention.

In this embodiment, as shown in FIGS. 17 and 18, on each of the first sub-flow equalizer 22 are uniformly arranged row by row a plurality of round longitudinally-finned tubes, in which the gap between the adjacent round finned tubes is separated by the radial fins. Comparing FIG. 18 with FIG. 8, it can be obviously seen that within the rectangular space where the heat exchange assemblies 40 are arranged, the radial fins dissipate heat in the direction perpendicular to the first sub-flow equalizer 22 and in the direction parallel to the first sub-flow equalizer 22. In the same volume, under the same gap density, the surface area of the fins on the round finned tubes employed a radial distribution are larger than that of the fins on the rectangular finned tubes employed a longitudinal distribution. The heat transfer efficiency of the round finned tubes employed a radial distribution is higher than that of the rectangular finned tubes employed a longitudinal distribution.

It should be noted that the heat exchanger comprising the round longitudinally-finned tube requires a relatively clean gas flow through the fins. When the gas is not cleaned, the fins are prone to being blocked near the round liquid guiding tube. However, such problem does not exist in the rectangular longitudinally-finned tube due to the fact that the spacing between the fins is equal.

Example 2, compared to Example 1, uses radially distributed fins instead of parallel-distributed fins. The fins are disposed obliquely with respect to the fins in a rectangular region in which the outer contour of the finned tube is located. In the case where the number of fins is the same, the surface area of the radially distributed fins is larger, and the surface area of the longitudinally distributed fins is smaller. The heat transfer efficiency of Example 2 is higher than that of Example 1.

Example 3

Example 3 differs from Examples 1 and 2 in that the first liquid distributor 20 according to Example 3 is further provided with a flow divider side tube 24 that connects to an end of the first main flow equalizer 23 and the liquid inlet 21 is arranged on the flow divider side tube 24.

Figure 20:
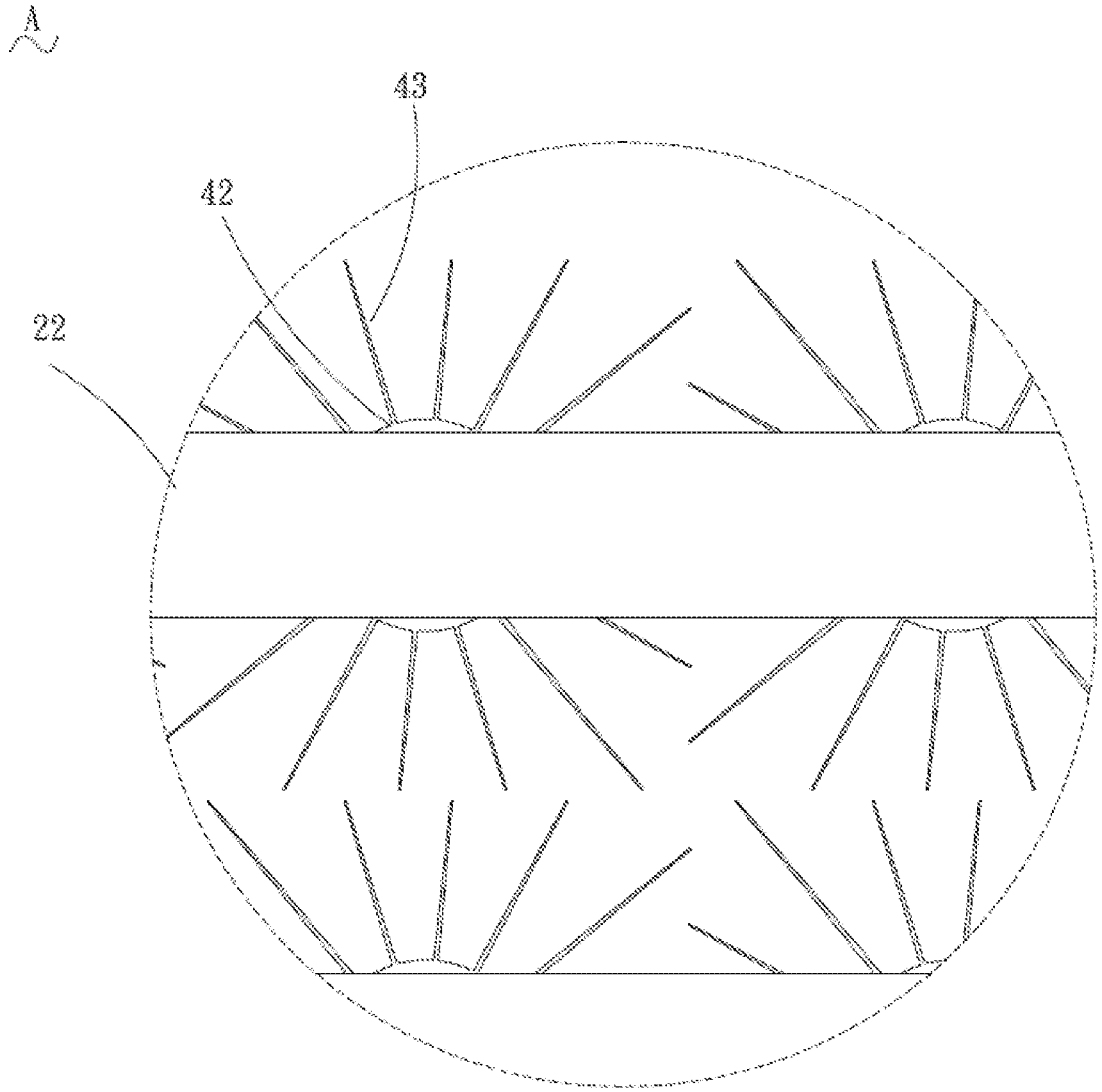
FIG. 20 is a partially enlarged schematic view showing Part A of FIG. 18.
Figure 21:
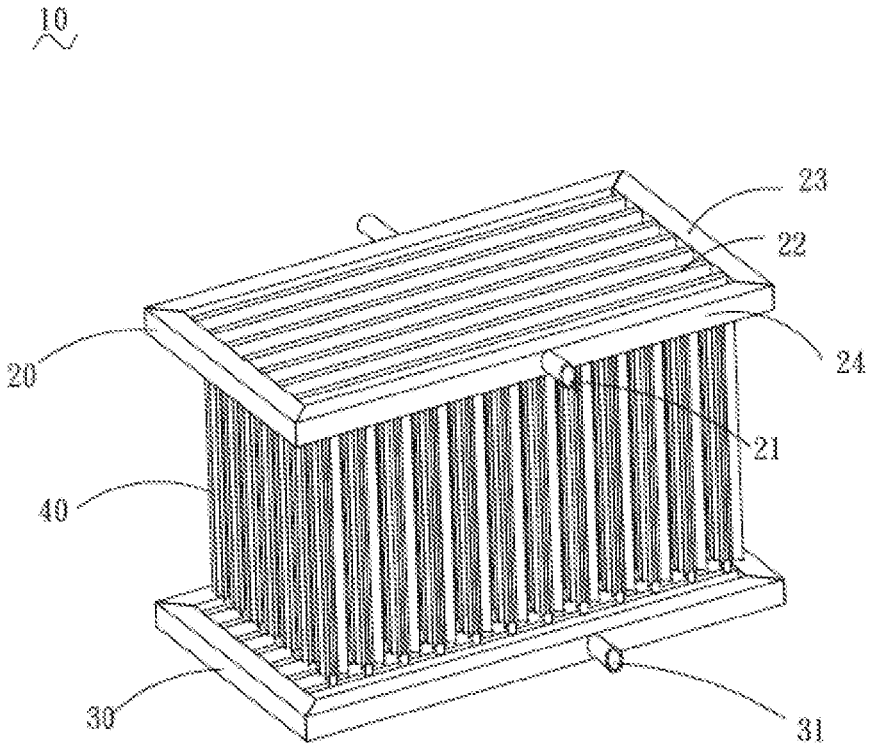
FIG. 21 shows a gas-liquid heat exchanger of Example 3 according to the present invention.

As shown in FIG. 20, the first liquid distributor 20 according to Example 3 is provided with a flow divider side tube 24 at each end of the first main flow equalizer 23, and a liquid inlet 21 is arranged on the flow divider side tube 24. The second liquid distributor 30 is provided with a flow divider side tube 24 at each end of the second main flow equalizer 33, and a liquid outlet 31 is arranged on the flow divider side tube 24. In this embodiment, the flow divider side tube 24 and the first main flow equalizer 23 communicate with each other. Liquid from the liquid inlet 21 enters the flow divider side tube 24 and then is divided into two liquid streams, which subsequently enter the two ends of the first main flow equalizer 23 from the flow equalizer plate. As for the wind resistance, similarly, the cross section of the second sub-flow equalizer 32 perpendicular to the length direction may be in the shape of a bullet or a triangle that protrudes away from the heat exchange assemblies. With such design, the width of the inlet of the gas gap is greater than the width of its outlet, and the resistance to gas is smaller. In this embodiment, on the one hand, the liquid goes in and out on the side, and on the other hand, the liquid from the liquid inlet is concentrated into the side tubes on both sides, and then goes together to enter the first main flow equalizer 23 from both ends of the first main flow equalizer 23, so that the liquid entering the first main flow equalizer 23 is relatively uniform. In the first main flow equalizer, there will not be less liquid far away from the liquid inlet.

In other embodiments, the first liquid distributor 20 and the second liquid distributor 30 are provided with a flow divider side tube 24 at one side of the first main flow equalizer 23 and second main flow equalizer 33. The flow divider side tube connecting to the first main flow equalizer 23 and the flow divider side tube connecting to the second main flow equalizer 33 may be arranged on one side or on two opposite sides. In the case where they are arranged on one side, the liquid enters or exits from one side, which is advantageous for installation. In the case where they are arranged on two opposite sides, the heat exchange stroke is longest and heat transfer efficiency is high.

In other embodiment, the first liquid distributor 20 can be provided with a flow divider side tube 24 only arranged on a side of the first main flow equalizer 23, while the second liquid distributor 30 is not provided with a flow divider side tube 24, achieving a uniform liquid supply. Liquid outlet is arranged on the second main flow equalizer 33.

In other embodiments, two or more liquid inlets 21 are arranged on the flow divider side tube 24. The arrangement of a plurality of liquid inlets brings more uniformity but higher cost.

Any combinations of the technical features of the above embodiments may be allowable. All combinations of the technical features of the above embodiments will not described in detail. However, as long as there is no contradiction in the combination of these technical features, it is considered to be within the scope of the invention.

It should be noted that the above embodiments are only used to explain the preferred technical solutions of the present invention, and are not limited thereto. Although the present invention is described in detail with reference to the preferred embodiments, those skilled in the art should understand that the modifications or equivalent substitutions of the present invention are not intended to be excluded from the scope of the invention.

We claim:

1. A gas-liquid heat exchanger, comprising:

a first liquid distributor provided with a liquid inlet arranged on one side of the first liquid distributor, a plurality of first sub-flow equalizers arranged to be spaced from each other and a first main flow equalizer that connects to the plurality of first sub-flow equalizers, the liquid inlet communicating with the plurality of first sub-flow equalizers via the first main flow equalizer, a gap between two adjacent first sub-flow equalizers acting as a gas outlet, a flow equalizer plate being arranged inside each of the first main flow equalizer and the plurality of first sub-flow equalizers to uniformly divide the liquid, each of the plurality of first sub-flow equalizers further comprising a liquid guiding plate arranged obliquely inside the first sub-flow equalizer and above the flow equalizer plate;

a second liquid distributor provided with a liquid outlet arranged on one side of the second liquid distributor, a plurality of second sub-flow equalizers arranged to be spaced from each other and a second main flow equalizer that connects to the plurality of second sub-flow equalizers, the liquid outlet communicating with the plurality of second sub-flow equalizers via the second main flow equalizer, a gap between two adjacent second sub-flow equalizers acting as a gas inlet;

heat exchange assemblies connecting the first liquid distributor and the second liquid distributor, the heat exchanger assemblies comprising a plurality of longitudinally-finned tubes evenly distributed in an array, each of the plurality of longitudinally-finned tubes comprising a liquid guiding tube and a plurality of fins connecting to the liquid guiding tube and perpendicular to the liquid guiding tube, the liquid guiding tube having one end communicating with one of the plurality of first sub-flow equalizers, and the other end communicating with one of the plurality of second sub-flow equalizers, a cross section of the longitudinally-finned tube parallel to a length direction of the liquid guiding tube being a rectangle, each of the plurality of fins extending along a length direction of the liquid guiding tube, the plurality of fins being evenly distributed around the liquid guiding tube, the plurality of fins on two adjacent longitudinally-finned tubes being arranged in an alternating manner, and the adjacent longitudinally-finned tubes fitting closely with each other.

2. The gas-liquid heat exchanger according to claim 1, wherein each of the plurality of longitudinally-finned tubes included in the heat exchange assemblies is a rectangular longitudinally-finned tube; the rectangular longitudinally-finned tube includes a rectangular liquid guiding tube and a plurality of fins connecting to the rectangular liquid guiding tube and perpendicular to the rectangular liquid guiding tube; the plurality of fins are uniformly distributed on the upper and lower sides of the rectangular liquid guiding tube.

3. The gas-liquid heat exchanger according to claim 1, wherein each of the plurality of longitudinally-finned tubes included in the heat exchange assemblies is a round longitudinally-finned tube; the round longitudinally-finned tube includes a round liquid guiding tube and a plurality of fins connecting to the round liquid guiding tube and perpendicularly and radially extending outwards with respect to the round liquid guiding tube as an axis.

4. The gas-liquid heat exchanger according to claim 1, wherein the first liquid distributor is further provided with a flow divider side tube that connects to an end of the first main flow equalizer; the flow divider side tube and the first main flow equalizer communicate with each other; the liquid inlet connects to the flow divider side tube.

5. The gas-liquid heat exchanger according to claim 1, wherein the flow equalizer plate is an orifice plate.

6. The gas-liquid heat exchanger according to claim 1, wherein the flow equalizer plate is a louver-type guiding plate.

7. The gas-liquid heat exchanger according to claim 1, wherein a cross section of one of the plurality of fins parallel to the length direction of the liquid guiding tube is a rectangle or a curve.

8. The gas-liquid heat exchanger according to claim 1, wherein the plurality of fins are provided with a sub portion.

9. The gas-liquid heat exchanger according to claim 1, wherein a cross section of one of the plurality of second sub-flow equalizers perpendicular to its length is a rectangle with a tapered tip that protrudes away from the heat exchange assemblies.

10. The gas-liquid heat exchanger according to claim 1, wherein a cross section of one of the plurality of second sub-flow equalizers perpendicular to its length is a triangle that protrudes away from the heat exchange assemblies.

* * * * *